US010508807B2

(12) United States Patent
Immer et al.

(10) Patent No.: US 10,508,807 B2
(45) Date of Patent: Dec. 17, 2019

(54) REMOTE BURNER MONITORING SYSTEM AND METHOD

(71) Applicant: AIR PRODUCTS AND CHEMICALS, INC., Allentown, PA (US)

(72) Inventors: Jeremy Glen Immer, Breinigsville, PA (US); Yan Zhao, Allentown, PA (US); Christopher Alan Ward, Alburtis, PA (US); Reed Jacob Hendershot, Orefield, PA (US); Aleksandar Georgi Slavejkov, Allentown, PA (US); Thomas David Matthew Lee, Basingstoke (GB); Michael J. Gallagher, Coopersburg, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 744 days.

(21) Appl. No.: 14/268,655

(22) Filed: May 2, 2014

(65) Prior Publication Data

US 2015/0316262 A1 Nov. 5, 2015

(51) Int. Cl.

| | |
|---|---|
| ***F23N 5/24*** | (2006.01) |
| ***F23N 5/26*** | (2006.01) |
| ***F23N 5/00*** | (2006.01) |

(52) U.S. Cl.

CPC ..... *F23N 5/242* (2013.01); *F23N 5/00* (2013.01); *F23N 5/265* (2013.01); *F23N 2023/02* (2013.01); *F23N 2023/08* (2013.01); *F23N 2023/38* (2013.01); *F23N 2023/54* (2013.01); *F23N 2025/00* (2013.01)

(58) Field of Classification Search

None

See application file for complete search history.

(56) References Cited

U.S. PATENT DOCUMENTS 3,705,783 A * 12/1972 Warren ..... F23N 5/123 431/46
3,781,161 A * 12/1973 Schuss ..... F23N 5/242 431/16

(Continued)

FOREIGN PATENT DOCUMENTS

CN 2690876 Y 4/2005
CN 102385370 A 3/2012

(Continued)

*Primary Examiner* — Avinash A Savani
*Assistant Examiner* — Martha M Becton
(74) *Attorney, Agent, or Firm* — Larry S. Zelson

(57) ABSTRACT

A remote burner monitoring system including one or more burners each including integrated sensors, a data collector corresponding to each of the burners for receiving and aggregating data from the sensors of the corresponding burner, and a local transmitter corresponding to each of the data collectors for transmitting the data, a data center configured and programmed to receive the data from the local transmitters corresponding to the one or more burners, and a server configured and programmed to store at least a portion of the data, to convert the data into a display format, and to provide connectivity to enable receipt and transmission of data and the display format via a network including at least one of a wired network, a cellular network, and a Wi-Fi network.

18 Claims, 7 Drawing Sheets

(56) References Cited

U.S. PATENT DOCUMENTS 3,954,383 A * 5/1976 Bryant ..... F23N 5/022 431/24
4,280,184 A * 7/1981 Weiner ..... F23N 5/082 340/578
4,303,383 A * 12/1981 Black ..... F23N 5/203 307/115
4,555,800 A * 11/1985 Nishikawa ..... F23N 5/003 250/554
4,703,888 A * 11/1987 Kawamura ..... B60H 1/2203 126/110 C
4,882,573 A * 11/1989 Leonard ..... F23N 5/082 340/578
5,039,006 A * 8/1991 Habegger ..... F23N 5/242 236/1 G
5,319,580 A * 6/1994 Sakata ..... G07C 3/00 702/185
5,425,316 A * 6/1995 Malone ..... F23G 5/006 110/190
5,481,481 A * 1/1996 Frey ..... G05B 19/0421 340/3.1
5,496,450 A * 3/1996 Blumenthal ..... F23N 5/006 110/185
5,515,297 A * 5/1996 Bunting ..... F23N 5/242 431/13
5,575,153 A * 11/1996 Ito ..... F02C 9/28 60/737
5,612,904 A * 3/1997 Bunting ..... F23N 5/242 431/13
5,658,140 A * 8/1997 Kondou ..... F23N 3/082 431/31
5,745,049 A * 4/1998 Akiyama ..... G06K 19/0723 340/10.41
5,761,092 A * 6/1998 Bunting ..... F23N 5/242 431/13
5,884,202 A * 3/1999 Arjomand ..... G01M 15/05 340/12.54
5,993,194 A 11/1999 Lemelson et al.
6,023,667 A * 2/2000 Johnson ..... F24F 11/0086 324/207.15
6,042,365 A 3/2000 Chen
6,164,957 A * 12/2000 Waters ..... F23N 5/16 340/577
6,416,317 B1 * 7/2002 Arnoux ..... F23D 14/22 431/13
6,535,838 B2 * 3/2003 Abraham ..... F23N 1/002 702/183
6,658,372 B2 12/2003 Abraham et al.
6,728,600 B1 * 4/2004 Contaldo ..... F23N 1/002 236/20 R
7,123,020 B2 * 10/2006 Hill ..... F23N 5/242 324/522
7,229,278 B1 6/2007 Newberry
7,382,140 B2 * 6/2008 Obrecht ..... F23N 5/123 324/678
7,414,525 B2 * 8/2008 Costea ..... F24F 11/0086 340/504
7,454,892 B2 * 11/2008 Lieuwen ..... F23D 14/725 60/39.091
7,568,909 B2 * 8/2009 MacNutt ..... F23N 5/00 431/27
7,606,681 B2 10/2009 Esmaili et al.
7,647,895 B2 * 1/2010 Donelly ..... F22D 1/12 122/14.21
7,847,706 B1 * 12/2010 Ross ..... G08C 17/02 340/12.52
7,927,095 B1 * 4/2011 Chorpening ..... F23N 1/022 431/12
8,544,423 B2 * 10/2013 Vogel ..... F22D 1/12 122/14.2
8,641,412 B2 * 2/2014 Cantu ..... F23C 6/04 126/44
8,783,243 B2 * 7/2014 Hodapp, Jr. ..... F24C 3/126 126/39 BA
8,823,714 B1 * 9/2014 Thielvoldt ..... F23N 1/002 126/500
8,881,535 B2 * 11/2014 Hartwick ..... F23D 14/84 431/8
8,909,494 B2 * 12/2014 Lorden ..... G01F 9/001 702/100
9,022,778 B2 * 5/2015 Schlachter ..... F23N 5/022 431/73
9,032,785 B1 * 5/2015 Miles ..... G01M 15/14 73/112.01
9,151,495 B1 * 10/2015 Archer ..... F23G 7/085
9,353,945 B2 * 5/2016 Gross ..... F23N 1/022
9,366,621 B2 * 6/2016 Howell ..... G01N 21/39
9,423,126 B1 * 8/2016 Archer ..... F23G 7/085
9,562,685 B2 * 2/2017 Cant ..... F23C 6/04
9,568,195 B2 * 2/2017 Cant ..... F23C 6/04
2002/0172903 A1 * 11/2002 Chen ..... F23N 1/007 431/43
2004/0112970 A1 * 6/2004 Feldmeth ..... F23N 5/02 236/20 R
2004/0121275 A1 * 6/2004 Diebold ..... F23N 5/265 431/18
2004/0265759 A1 * 12/2004 Harbeck ..... F23C 3/002 431/16
2005/0130086 A1 * 6/2005 MacNutt ..... F23N 5/00 431/14
2005/0150218 A1 * 7/2005 Crawley ..... F01N 3/025 60/295
2005/0162109 A1 * 7/2005 Randals ..... F23N 5/00 318/269
2005/0284463 A1 * 12/2005 Hill ..... F23N 5/242 126/110 R
2006/0068347 A1 * 3/2006 Li ..... F23D 11/26 431/12
2006/0199122 A1 * 9/2006 Matteson ..... F23N 5/123 431/75
2007/0019361 A1 1/2007 Obrecht
2007/0235020 A1 * 10/2007 Hills ..... F23N 1/002 126/512
2008/0078337 A1 * 4/2008 Donnelly ..... F22D 1/12 122/446
2008/0087013 A1 * 4/2008 Crawley ..... F01N 3/0231 60/320
2008/0264310 A1 * 10/2008 Jia ..... F23C 9/003 110/186
2009/0004612 A1 * 1/2009 West ..... F23N 1/002 431/22
2009/0181334 A1 * 7/2009 Moore ..... F23N 5/102 431/60
2009/0215375 A1 * 8/2009 Hagensen ..... F23L 17/005 454/42
2009/0246720 A1 * 10/2009 Schlachter ..... F23N 5/022 431/73
2010/0116227 A1 * 5/2010 Vogel ..... F22D 1/12 122/446
2012/0052454 A1 * 3/2012 Roy ..... F23D 23/00 431/74
2012/0100492 A1 * 4/2012 Hodapp, Jr. ..... F23N 5/242 431/12
2012/0317985 A1 * 12/2012 Hartwick ..... F23D 14/84 60/722
2012/0317986 A1 * 12/2012 Zajadatz ..... F23R 3/346 60/725
2013/0071794 A1 * 3/2013 Colannino ..... F23D 14/84 431/2
2013/0291552 A1 * 11/2013 Smith ..... F23N 5/16 60/779
2014/0088918 A1 * 3/2014 Miller ..... G01M 99/00 702/179
2014/0162197 A1 * 6/2014 Krichtafovitch ..... F23C 99/001 431/2
2015/0051847 A1 * 2/2015 Angello ..... F01D 21/003 702/35

(56) References Cited

U.S. PATENT DOCUMENTS

| | | | | |
|---|---|---|---|---|
| 2015/0167972 | A1* | 6/2015 | Zhdaneev | F23N 5/003 431/5 |
| 2015/0292405 | A1* | 10/2015 | Pearce | F23N 5/00 431/13 |
| 2016/0091205 | A1* | 3/2016 | Solosky | F23N 5/082 431/2 |
| 2016/0091903 | A1* | 3/2016 | Patton | F23N 5/203 700/276 |
| 2017/0191659 | A9* | 7/2017 | Wiklof | F23N 1/002 |

FOREIGN PATENT DOCUMENTS

| | | | |
|---|---|---|---|
| CN | 202361408 | | 8/2012 |
| CN | 102777972 | A | 11/2012 |
| CN | 202939164 | U | 5/2013 |
| CN | 103574635 | | 2/2014 |
| CN | 203571699 | U | 4/2014 |
| DE | 202007005787 | | 6/2007 |
| DE | 202007005787 | U1 | 6/2007 |
| EP | 0325356 | A2 * | 7/1989 |
| EP | 1004974 | A2 | 5/2000 |
| KR | 1020050082750 | A | 8/2005 |
| TW | 201215828 | A | 4/2012 |
| TW | 201248131 | A | 12/2012 |
| WO | 2013077861 | | 5/2013 |

* cited by examiner

REMOTE BURNER MONITORING SYSTEM AND METHOD

BACKGROUND

This application relates to a combustion system including a burner having integrated sensors and a data collection and transmission apparatus to enable remote monitoring of burner operation.

Burners, by their nature, operate in harsh environments, since they are used to provide combustion heat to all sorts of industrial furnaces. Often, the only way to assess burner performance is to monitor local gauges and other (sometimes temporarily mounted) sensors at the furnace, where heat, dust, and vibration are prevalent. Some attempts in the art have been made to provide remote data monitoring and alarming based on sensors mounted at the burner, but none of these has done so in an integrated wireless manner that enables remote real-time monitoring of burner operation, both locally (i.e., in the plant but away from the burner) and from a distance (e.g., over the Internet).

SUMMARY

A system is described for remotely monitoring burners that are instrumented to measure burner parameters to enable monitoring of burner performance and to assist in predictive maintenance by detecting changes in operation of the burner before a failure or shutdown occurs. Furnaces parameters may also be monitored for the same reasons. The burner instrumentation is integrated with the burner, for example as described in commonly owned patent application entitled "Oil Burner with Monitoring" and commonly owned provisional patent application entitled "Burner with Monitoring" that are being filed concurrently with this application, each of which is incorporated by reference herein in its entirety. Such instrumentation can be integrated into any burner, including a burner that uses one or more of gaseous fuel, liquid fuel, and solid fuel, and including a non-staged burner, a fuel-staged burner, an oxidant-staged burner, and a burner in which both fuel and oxidant are staged. It is understood that for each type of burner, the type, position, and quantity of sensors can be customized to correspond to the operational modes and parameters most relevant to that particular burner.

The resultant data is transmitted wirelessly to a central location such as a receiving data center where data from one or multiple burners is collected and can be retransmitted. Depending on the layout of the facility, it may be advantageous to use more than one data center to receive data from burners located in respective proximity to each data center. The data may be used for any purpose, including monitoring the burners operation for maintenance needs or for optimization possibilities, and for trending, alarming, and the like. The data is provided in a form that can be either manually observed, for example by an operator, or through software that can inform operators of abnormal or suboptimum performance. Such information may be provided in the form of screen alerts, emails, text messages, or other means.

The receiving data center aggregates data from one or multiple burners and is capable of retransmitting that data via a network such as Internet, an intranet, a local area network (LAN), and a wide area network (WAN). The data center may include a server that serves up the data in a format that is accessible to authorized users, such as a web page or mobile device app. Alternative, a cloud-based server on the network may be used to provide data directly or indirectly to users via the network. The data center may also, or alternatively, provide the data over a restricted access Wi-Fi or Blue Tooth so that authorized users can access the data from any location within the vicinity of the data center including at the burners or at locations that provide inputs such as fuel and oxidant flow to the burners. The data center may also have the capability to archive the data locally or in a cloud-based remote data repository for later retrieval. Further, software can be run either locally at the data center or on a cloud-based server to perform various features, such as monitoring trends of the data from one or multiple burners, and/or providing comparisons between burners or to known optimum conditions. The data from the burners could also be used to control the furnace and burner operation either in a closed loop or open loop fashion both to keep burner parameters within safe or in-control limits and to automatically tune local flame characteristics to user-set values including without limitation heat flux and flame length, and also to quickly respond to warning signs including without limitation burner nozzle or block overheating or flame instability.

Aspect 1. A remote burner monitoring system comprising: one or more burners each including integrated sensors; at least one data collector corresponding to each of the burners for receiving and aggregating data from the sensors of the corresponding burner, and at least one local transmitter corresponding to each of the data collectors for transmitting the data; a data center configured and programmed to receive the data from the local transmitters corresponding to the one or more burners; and a server configured and programmed to store at least a portion of the data, to convert the data into a display format, and to provide connectivity to enable receipt and transmission of data and the display format via a network including at least one of a wired network, a cellular network, and a Wi-Fi network.

Aspect 2. The system of Aspect 1, further comprising: a computer configured and programmed to transmit and receive data to and from the network.

Aspect 3. The system of Aspect 1 or Aspect 2, wherein the data center includes one or more of a data receiving for receiving the data, a server for storing at least a portion of the data, and a router for providing connectivity to enable network receipt and transmission of data.

Aspect 4. The system of any one of Aspects 1 to 3, wherein the data collector of each of the burners is programmed to provide a correct voltage to each of the integrated sensors of the burner.

Aspect 5. The system of any one of Aspects 1 to 4, wherein the data collector of each of the burners is programmed to provide power to individual sensors only when data is to be collected, based on one or both of a combination of sensed data and a periodic schedule, and taking into account the specific requirements of each of the individual sensors.

Aspect 6. The system of any of Aspects 1 to 5, wherein the local transmitter corresponding to each of the burners transmits data wirelessly, either directly to the receiver server or indirectly via one or more Wi-Fi repeaters, as required by the distance and signal path between the burner and the receiver server.

Aspect 7. The system of any of Aspects 1 to 6, wherein the display format is selected from the group consisting of: an Internet web page format and a mobile device app format.

Aspect 8. The system of any one of Aspects 1 to 7, wherein the data collector corresponding to each burner is powered by local energy harvesting.

Aspect 9. The system of any one of Aspects 1 to 8, wherein at least one of the burners uses an oxidant selected from the group consisting of: air, oxygen-enriched air, industrial grade oxygen, and combinations thereof.

Aspect 10. The system of Aspect 9, wherein at least one of the burners is configured to combust a fuel selected from the group consisting of: gaseous fuel, liquid fuel, solid fuel, and combinations thereof.

Aspect 11. The system of Aspect 9 or Aspect 10, wherein at least one of the burners is configured to perform staged combustion.

Aspect 12. The system of any one of Aspects 1 to 11, wherein the server is integrated with the data center.

Aspect 13. The system of any one of Aspects 1 to 11, wherein the server is located in the cloud.

Aspect 14. A method of monitoring operation of one or more burners, the method comprising: sensing operational data at each of the burners; locally collecting the data at each of the burners; transmitting the collected data from each of the burners to a data center; converting the data into a display format; transmitting the display format via a network including at least one of a wired network, a cellular network, and a Wi-Fi network.

Aspect 15. The method of Aspect 14, wherein converting the data into a display format comprising serving up the data in one or more of an Internet web page format and a mobile device app format.

Aspect 16. The method of Aspects 14 or Aspect 15, further comprising: transmitting the collected data from the data center via the network to the cloud; storing the collected data in a remote data repository; and enabling access via the network to the collected data stored in the remote data repository.

Aspect 17. The method of any one of Aspects 14 to 16, further comprising: analyzing the collected data including performing statistical analysis of the collected data corresponding to one of the burners, performing comparative analysis of the collected data between two or more of the burners, comparing the collected data for one or more of the burners to preset alarm setpoints and generating alarms, and combinations thereof.

Aspect 18. The method of any one of Aspects 14 to 17, further comprising: controlling operation of the one or more burners based on the collected data and analysis of the collected data; wherein controlling operation includes one or more of maintaining burner operating parameters within prescribed limits, tuning local flame characteristics, and rapidly responding to adverse burner conditions.

Aspect 19. The method of Aspect 18, wherein the local flame characteristics include one or more of heat flux and flame length.

Aspect 20. The method of Aspect 18, wherein the adverse burner conditions include one or more of an elevated temperature of a burner component, an elevated temperature of a furnace component, and flame instability.

Other aspects of the invention are described below.

DETAILED DESCRIPTION

An oxy-fuel burner typically includes at least one oxidant passage for supplying oxidant to at least one oxidant nozzle and at least one fuel passage for supplying fuel to at least one fuel nozzle. Additionally, in a staged oxy-fuel burner, one or both of fuel and oxidant (e.g., oxygen) is staged such that a primary stream participates in initial combustion while a secondary stream participates in delayed combustion away from the burner. For example, for oxidant staging, the oxidant is proportioned between a primary oxidant passage and a secondary oxidant passage, with the secondary oxidant being supplied to at least one secondary oxidant nozzle spaced apart from the primary oxidant nozzle(s) and fuel nozzle(s). Such staging may be accomplished by a staging valve upstream of the primary and secondary oxidant passages that proportions one incoming oxidant stream between the two passages. Alternatively, the flow to each of the primary and secondary oxidant passages may be independently controlled by a separate control valve. In other burners, fuel may be staged similarly, using either a staging valve or separate flow controls for primary and secondary streams. Further, in some burners, both fuel and oxidant may be staged.

Therefore, significant information can be gleaned about the operation of a burner by sensing parameters including but not limited to the inlet fuel temperature and pressure and composition information, the inlet oxidant pressure, nozzle tip temperatures (fuel, primary oxidant, secondary oxidant), the burner and/or burner block face temperature at various locations, the furnace wall temperature, the staging valve position (for fuel and/or oxidant), the relative position and angle of various burner components, and the atomizing gas pressure (in a liquid fuel burner), whether alone or in combination with each other.

Burners can be provided with integrated sensors. In one embodiment, one or more burners with integrated sensors, for example sensing temperatures, pressures, and positions and angles, that transmit data back to a data receiving center, and the data receiving center collects and retransmits the data either locally or remotely for use, evaluation, analysis, alarming, or other process function. Optionally, the data receiving center can provide alerts to users regarding abnormal or undesired operation. Alerts can be done via text messages, emails, flashing lights, web page indicators, a phone call with a prerecorded message, or others mechanisms.

Figure 3A:
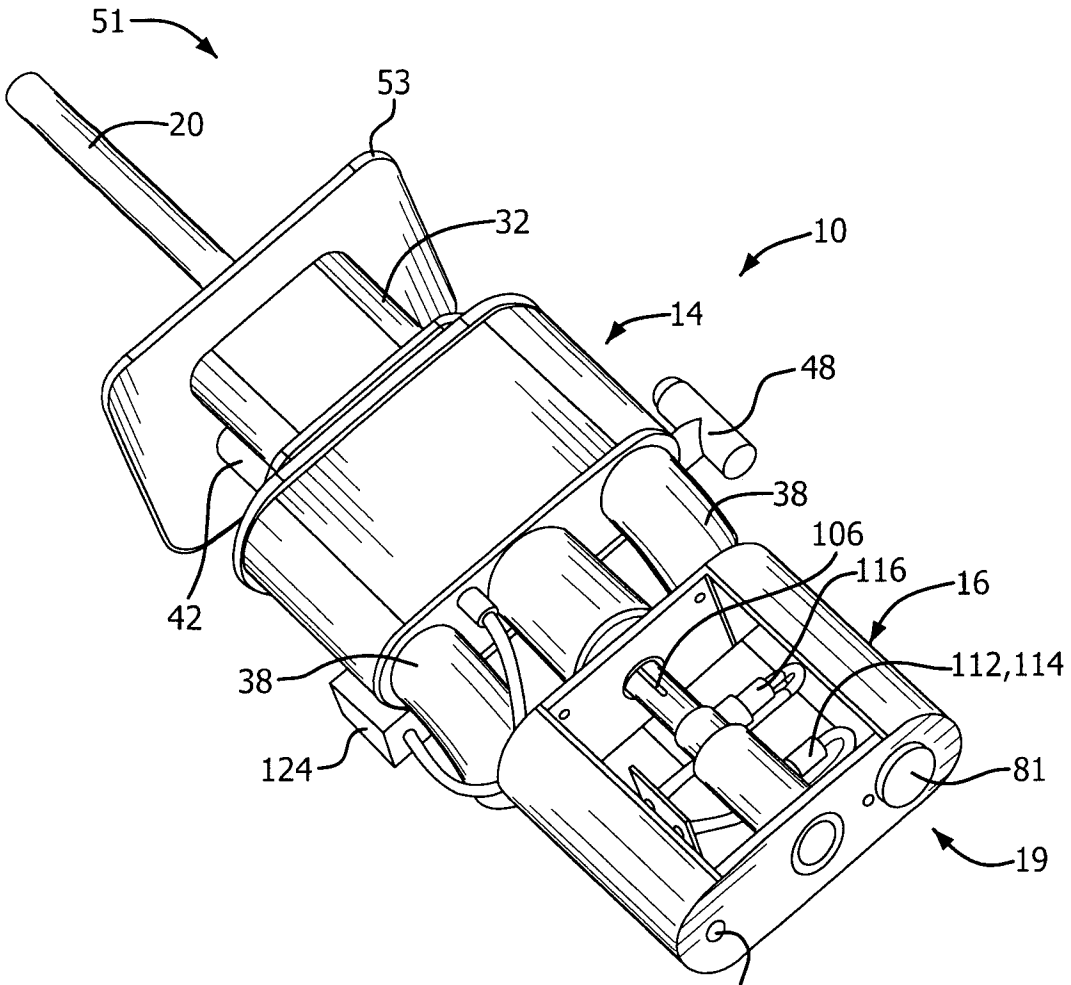
FIG. 3A is rear perspective view of an exemplary burner with monitoring for insertion into a burner block.
Figure 3B:
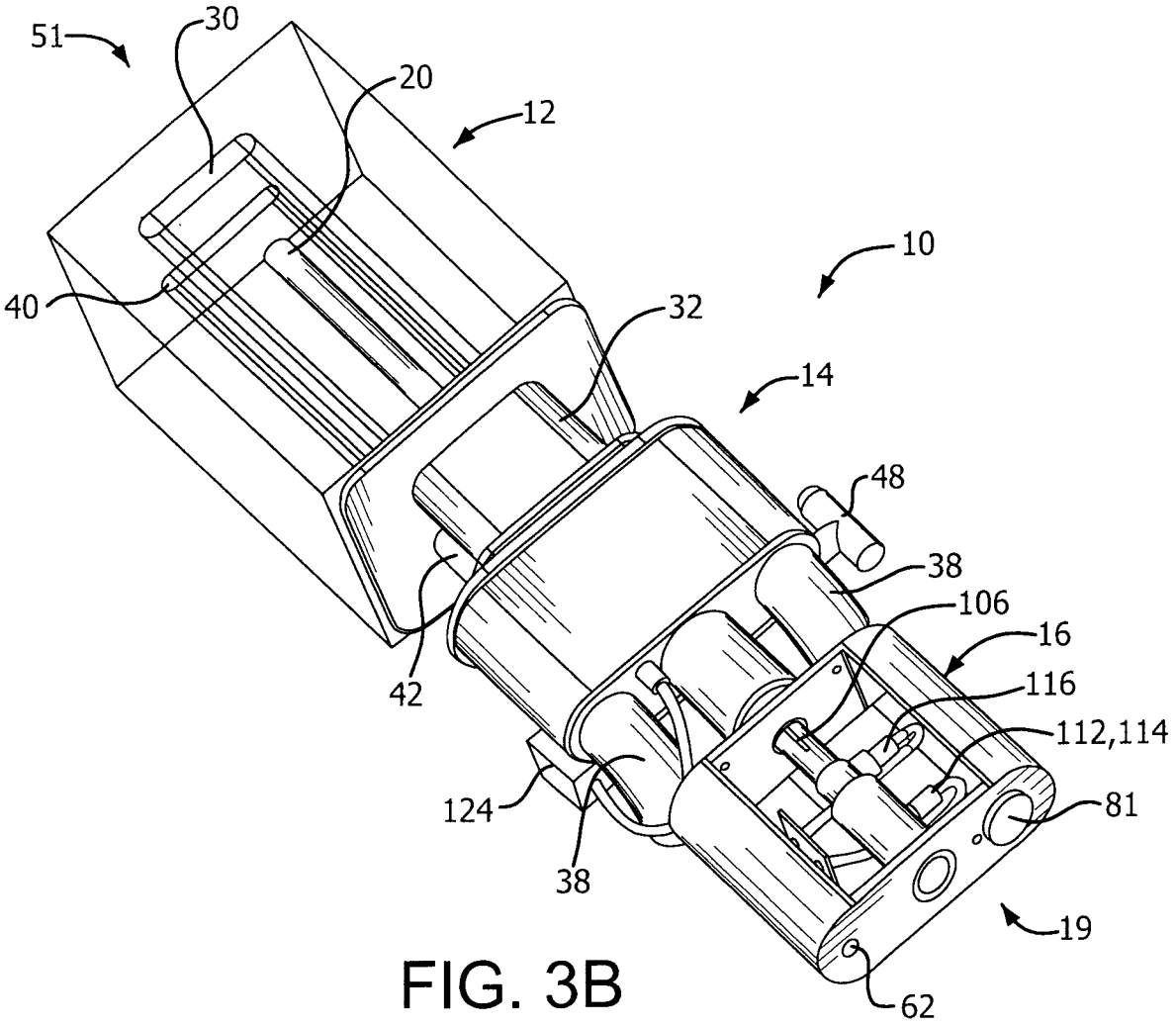
FIG. 3B is a rear perspective view of an exemplary burner with monitoring as in FIG. 3A inserted in a burner block.
Figure 4:
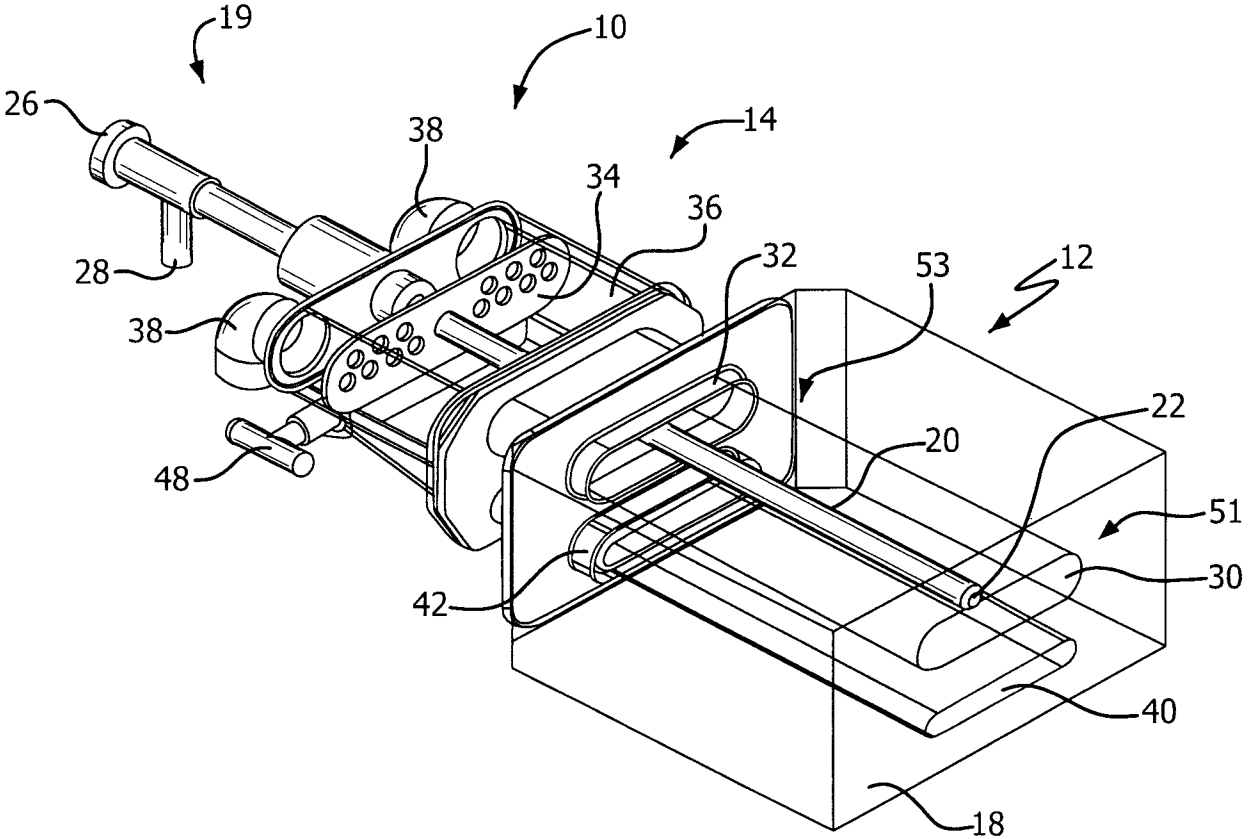
FIG. 4 is a front perspective view of an exemplary burner similar to the burner in FIG. 3A inserted in a burner block, but without monitoring capabilities.
Figure 5:
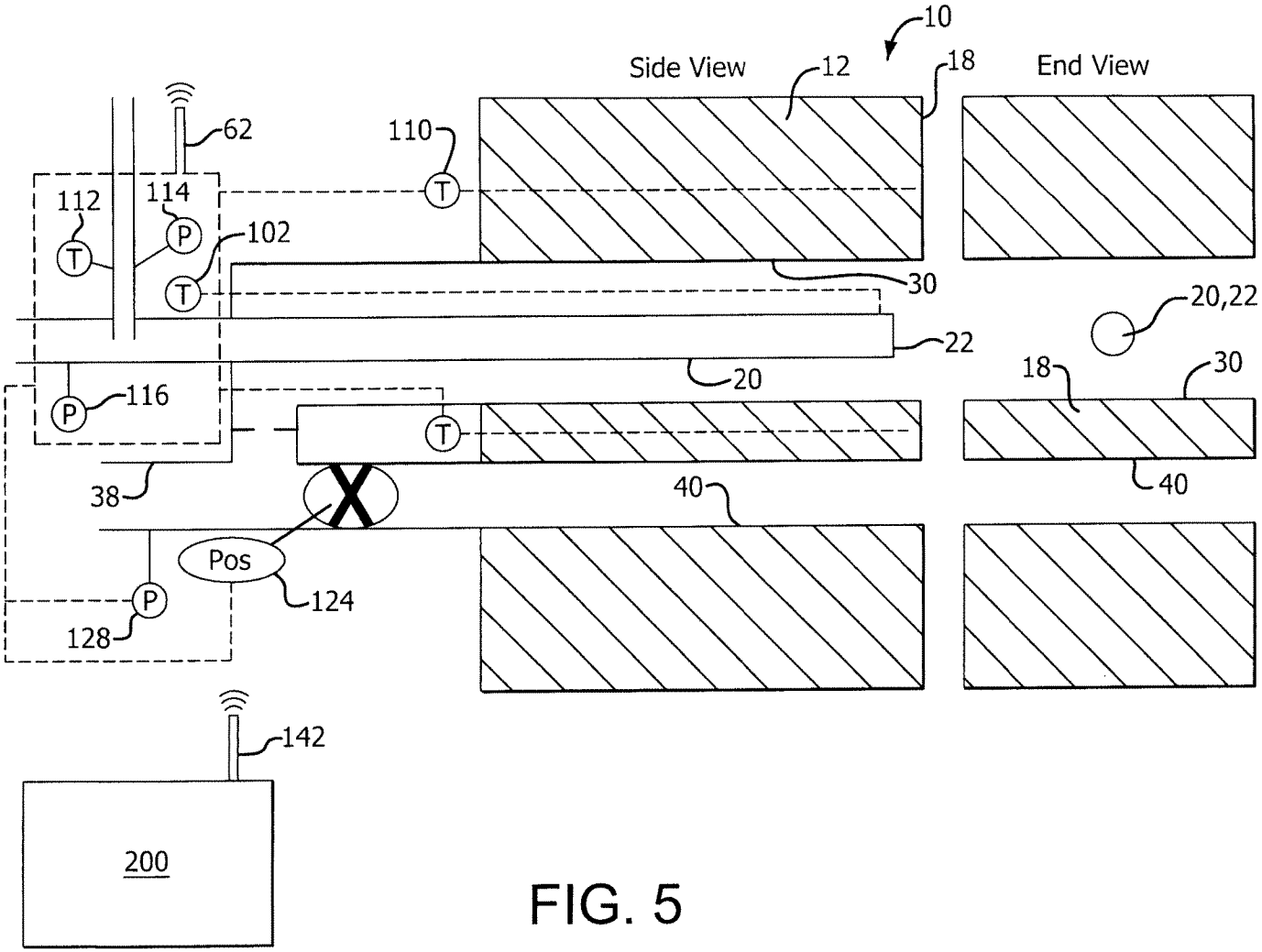
FIG. 5 is a cross-sectional view of an exemplary burner with monitoring inserted in a burner block.

For example, FIGS. 3A, 3B, and 5 depict an embodiment of a staged oxy-oil burner 10 with integrated sensors, power supply, and communications equipment. Although an oxy-oil burner is described herein as an exemplary embodiment of a burner with monitoring, the same or similar communications equipment and methods, along with similar or analogous integrated sensors, customized to the configuration, design, and operational mode of the particular burner, can be used on burners that combust gaseous fuel with oxidant. In particular, with the exception of parameters that relate specifically to oil combustion, such as the oil and atomizing gas inlet pressures, all of the parameters and sensors described herein are similarly applicable to a burner combusting any fuel, including gaseous fuel, solid fuel (e.g., petcoke) in a carrier gas, or liquid fuel.

The power supply is preferably a battery or a local power generator for ease of installation and to avoid possible safety issues with wired power. The sensors may include but not limited to, in any combination, temperature sensors, pressure sensors, position sensors, angle sensors, contact sensors, gyroscope, sound sensors, vibration sensors, IR or UV sensors, gas composition sensors, accelerometers, and flow sensors.

The burner 10 has a discharge end 51 and an inlet end 19. For convenience of description, the discharge end 51 is sometimes referred to herein as the front or forward direction of the burner 10, while the inlet end 19 is sometimes referred to as the rear or rearward direction of the burner 10. When the burner 10 is mounted in a furnace, the discharge end 51 faces the interior of the furnace.

The burner 10 includes a burner block 12, a burner body 14 positioned rearward from burner block 12 with respect to the furnace, and an instrument enclosure 16 positioned rearward with respect to the burner body 14. The burner body 14 includes a mounting plate 53 that is secured to the burner block 12. The burner block 12 has a front face 18 that, when mounted, faces into the furnace.

The burner block 12 includes a primary oxidant passage 30. An oil lance 20 is positioned within the primary oxidant passage 30 and has an atomizing nozzle 22 at its discharge end. The atomizing nozzle 22 is substantially surrounded by the primary oxidant passage 30 so that atomized fuel oil discharged from the nozzle 22 will mix intimately with the primary oxidant stream upon discharge. Preferably, the oil lance 20 and the nozzle 22 are separately manufactured parts that are joined together, for example by welding, to form a unitary lance with nozzle. In the depicted embodiment, the oil lance 20 substantially centrally positioned within the primary oxidant passage 30, although it is understood that the oil lance 20 may be located in a non-central provided the nozzle 22 is adapted to distribute the atomized oil to be adequately mixed with the primary oxidant stream for combustion. Alternatively, for an oxy-gas burner, a gaseous fuel passage can be positioned within the primary oxidant passage 30 in place of the oil lance 20. The burner block 12 further includes a secondary oxidant passage 40 spaced apart by a fixed distance from the primary oxidant passage 30.

The primary oxidant passage 30 is fed oxidant from a primary oxidant conduit 32 positioned in the burner body 14 and extending into a rear portion of the burner block 12. Oxidant is fed through a pair of oxidant inlets 38 into an oxidant plenum 36 that in turn feeds the primary oxidant conduit 32. A diffuser 34 may be positioned between the oxidant inlets 38 and the oxidant plenum 36 to aid in straightening out the primary oxidant flow prior to entering the primary oxidant conduit 32.

The secondary oxidant passage 40 is fed oxidant from a secondary oxidant conduit 42 positioned in the burner body 14 and extending into a rear portion of the burner block 12. A staging valve 48 in the burner body 14 redirects a portion of the oxidant supplied by the oxidant inlets 38 into the secondary oxidant conduit 42. The term "staging ratio" is used to describe the proportion of oxidant that is redirected to the secondary oxidant conduit 42, and thus away from the primary oxidant conduit 32. For example, at a staging ratio of 30%, 70% of the oxidant is directed to the primary oxidant conduit 32 (and thus to the primary oxidant passage 30) as a primary oxidant stream and 30% of the oxidant is directed to the secondary oxidant conduit 42 (and thus to the secondary oxidant passage 40) as a secondary oxidant stream.

The oxidant gas fed to the oxidant inlets 38 may be any oxidant gas suitable for combustion, including air, oxygen-enriched air, and industrial grade oxygen. The oxidant preferably has a molecular oxygen (02) content of at least about 23%, at least about 30%, at least about 70%, or at least about 98%.

The oil lance 20 extends rearward through the burner body 14 and through the instrument enclosure 16. Fuel oil is supplied to the oil lance 20 through an oil inlet 26. Due to the viscosity of fuel oil, it is typically necessary to also supply an atomizing gas to the oil lance 20 through an atomizing gas inlet 28. The atomizing gas may be any gas capable of atomizing the fuel oil as it exits the nozzle 22, including air, oxygen-enriched air, or industrial grade oxygen.

Various temperature sensors may be used for monitoring the temperature of burner components and for help determine fuel inlet conditions. In the depicted embodiment of FIGS. 3A, 3B, and 5, a temperature sensor 102 is embedded in the atomizing nozzle 22 in the oil lance 20 for measuring the temperature at the discharge end of the oil lance 20. Temperature sensors may be placed on other components of the burner 10 to monitor operational parameters such as burner integrity, flame stability, flame position. For example, one or more temperature sensors 110 may be mounted in the burner block 12 near the front face 18. The temperature sensors 110 are preferably set back slightly from the front face 18 to protect them from the furnace environment. The temperature sensors 110 may be centered with respect to the primary oxidant passage 30, or offset from the minor axis centerline. and may be used to determine whether the flame is impinging on the burner block 12 or whether the flame is centered about the oil lance 20 or the primary oxidant passage 30. Temperature sensors may even be positioned in other locations of the furnace proximate to the burner for monitoring combustion conditions.

A temperature sensor 112 positioned in the oil stream near the oil inlet 26 to monitor the temperature of the oil being supplied to the burner 10. It is important to ensure that the viscosity of the oil stream will enable proper oil atomization, and the viscosity is a function of temperature as well as oil composition. Therefore, for any particular oil composition, an optimum temperature range can be determined for atomization.

In the depicted embodiment, pressure sensors are also installed in the burner 10. A pressure sensor 114 is positioned in the oil stream near the oil inlet 26. The pressure sensor 114 may be mounted in the same sealing mechanism 61 as the temperature sensor 112, with the pressure sensor 114 being located in a different sensor port (not shown). Alternatively, the pressure sensor 114 may be mounted in a separate sealing mechanism having essentially the same construction as the sealing mechanism 61. In the embodiment of FIG. 5, a pressure sensor 116 is mounted in the atomizing gas stream near the atomizing gas inlet 28, and a pressure sensor 128 is mounted in the oxidant stream either near one of the oxidant inlets 38 or in the oxygen plenum 36 upstream of the staging valve 48. If desired, separate oxidant pressure sensors may be mounted in each of the primary oxidant conduit 32 and the secondary oxidant conduit 42 to detect the pressure of oxidant being supplied to each of the oxidant passages 30 and 40, respectively, in the burner block 12. The pressure sensors may be located inside or outside of the instrument enclosure 16, and are wired by cable for both power supply and signal transmission.

The instrument enclosure 16 includes a battery port 81 and an antenna (not shown) for wireless communication of data.

Note that similar configurations to the foregoing could be used to mount other sensors to monitor any of the feed streams.

Measuring the oil pressure can provide information about the flow resistance of the oil lance (e.g., decreased flow area due to coking or some other blockage will cause a pressure rise), the flowrate of the oil, and the viscosity of the oil (which is a function of temperature and composition). The oil pressure information is likely to be more useful when combined with other information (e.g., the oil temperature, the oil flowrate, the burner tip temperature, and data trending) in detecting maintenance needs of the oil lance.

Measuring the atomizing oxidant pressure also provides information about the oil flowrate and resistance and is therefore related to the oil pressure, but it is typically not the same and provides another element of information. Both of these instruments are located within the instrument box on the oil lance.

The oxygen pressure measurement provides information about the oxygen flowrate, flow resistance (i.e. blockage that may occur), and staging valve position.

The instrument enclosure 16, which is shown in partial cutaway in FIGS. 3A and 3B, is sealed and insulated to protect instrumentation contained therein from the dust and heat of a furnace environment. The instrument enclosure is positioned toward the rear 19 of the burner 10 to reduce the radiant heat energy received from the furnace. The instrument enclosure 16 includes at least a data collector 60, a power supply, and a transmitter 62 for sending data from the data collector 60 to a data center 200 (which may collect and display data from multiple burners, or retransmit data for display elsewhere) located either locally or remotely. Depending on the quantity and location of burners 10, and the quantity and type of sensors, more than one data collector 60 and/or more than one transmitter 62 may be required per burner 10, and/or more than one data center 200 may be used.

The power supply is used to power the pressure sensors, the data collector, and the transmitter, and any other sensors and equipment requiring power. Preferably, the power supply is powered by a local battery that may or may not be charged via local energy harvesting or power generation to avoid having to wire outside power to the instrument enclosure 16. For example, local power generation may include using temperature gradients, mass flow, light, induction, or other means to generate sufficient power to support the sensors and other associated equipment in the instrument enclosure 16.

Figure 6:
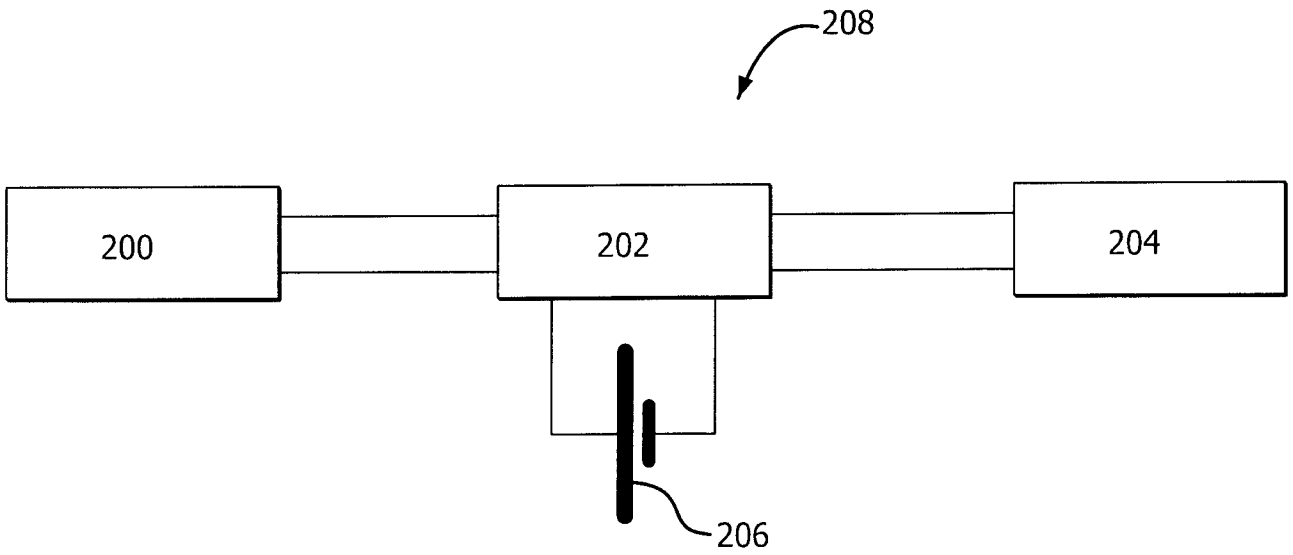
FIG. 6 is a schematic showing components of a local power generation system for powering a locally positioned data collector and/or a data center.

Power may be supplied to the data collector 60 by a local power generation system. FIG. 6 is a schematic of an exemplary local power generation system 208 to provide electrical power to the data collector 60. In the depicted embodiment, the local power generation system 208 includes a rechargeable battery 206 or super capacitor, and an energy harvester 204. The rechargeable battery 206 may include, for example, one or more lithium ion batteries or the like. Charging and discharging of the battery 206 is controlled by a battery supervisor 202, which is positioned as a hub between the data collector 60, the battery 206, and the energy harvester 204. The battery supervisor 202 can be configured to perform various functions, including but not limited to one or more of the following, alone or in combination: conditioning power flowing to and from the battery 206 and the energy harvester 204, maximum power point tracking to maximize harvested energy efficiency from the energy harvester 204, and permitting the data collector 60 to turn on only when there is sufficient energy available in the battery 206. Local power generation systems 208 as described herein may be used to respectively power individual data collectors 60 located at each burner 10, or one local power generation system may power one or more nearby data collectors 60. These local power generation systems can operate to store power during periods of low usage and release power during periods of high usage, thereby minimizing the required capacity of the energy harvester. In addition, similar local power generation systems 208 can be used to power the one or more data centers 200.

Advanced power management helps ensure long-term operation of the system on limited battery or locally generated power supply. Power is supplied to a customizable Wireless Intelligent sensor Node (WIN) that is highly configurable to provide the correct required voltage each of the different sensors. Moreover, the WIN intelligently turns off power to individual sensors when they are not in use, collects data from the sensors when in use, and transmits the data at configurable time intervals. An indicator light exists to show the status of the system and also to provide alerts. By powering the sensors only when they are used (e.g., on a predetermined time rotation to obtain periodic measurements), this conserves power from the power supply. However, it has been determined that some sensors, including but not limited to pressure sensors, may not give reliable data immediately after being powered up and do not respond well to being powered for only brief amounts of time. Therefore, the system requires both careful selection of sensors and specific configuration of the WIN to match the power up and power down cycles with the operating requirements of each sensor.

The data collector receives signals from all the sensors, and the transmitter sends the collected signal data to a data center, where a user can view the status of the various parameters being measured or which retransmits the data to a local or remote display for viewing. The data center 200 may be located locally to the data collector(s), and may receive data via a Wi-Fi network. Alternatively, the data center may be located remote and may receive data via a cellular network or other network. In one embodiment, the data center includes a server and all attendant functionality. In another embodiment, the data center may be essentially a bridge between the network of data collectors and sensors and a WAN (e.g., the Internet). For example, the bridge could be a Wi-Fi access point or a cellular base station.

In the depicted embodiment, the burner 10 also has a rotation sensor 124 on the staging valve 48 to detect the percent staging. The rotation sensor 124 may include but is not limited to, a Hall effect type sensor, accelerometer type sensor, a potentiometer, optical sensor, or any other sensor that can indicate rotational position. Additional position and angle sensors may be used to determine the position and/or angle of the burner body 14 relative to the furnace or the burner block 12, the position and/or angle of the lance 20 relative to the burner body 14 or the burner block 12, the insertion depth of the lance 20, and any other angles or positions that may be relevant to the operation of the burner 10.

For example, position sensors on the oil lance 20 can be used to detect and verify correct insertion depth and to log the information for tracking performance. Angle sensors on the burner 10 can be used to ensure that the burner is installed properly. This could be for ensuring that the burner angle is the same as the mounting plate for proper seating. In addition it is sometime desirable to install the burner at a given angle with respect to horizontal. Other sensors such as contact sensors between the burner and mounting plate could be used to ensure proper mounting of the burner to the mounting plate. By using one or more such sensors (preferably at least two) the burner can do a check on its installation to ensure that it is not ajar and is indeed in contact with both sensors (for example, a top sensor and a bottom sensor, or a left sensor and right sensor, or all four positions).

Additional connection ports may be located on the oil lance 20, the burner body 14, and/or the burner block 12 to enable additional external sensors or other signals to be connected to the data collector 60 for transmission to the data center 200.

In one embodiment of the system, each burner body 14 and each oil lance 20 has a unique identifier. This is useful since oil lances can be separated from the burner body and may be switched to different burner bodies. By incorporating a unique identifier on the burner body and lance, the communications equipment in the instrument box, which travels with the lance, can identify which burner body it is connected to for historical data archiving, trend analysis, and other reasons. This identifier could be RFID, a type of wireless transmitter, bar code, a one-wire silicon serial number, a unique resistor, a coded identifier, or any other identifying means.

Measuring the various temperatures, pressures, and positions of the burner and its components and feed streams and inputs from the other associated equipment including flow control skids, separately and in combination, can provide valuable information that enables an operator to perform preventive maintenance only when needed and to avoid costly unexpected failures or shutdowns.

In one working embodiment, a burner is configured to collect and transmit data from thermocouples, pressure transducers, a potentiometer used to measure a valve rotation angle. Other sensors such as accelerometers, magnetic sensors, optical encoders, proximity sensors, IR sensors, acoustic sensors, camera and video recording devices, and various other known measurement devices could be used in addition to or independently from the sensors in this working embodiment.

Figure 1:
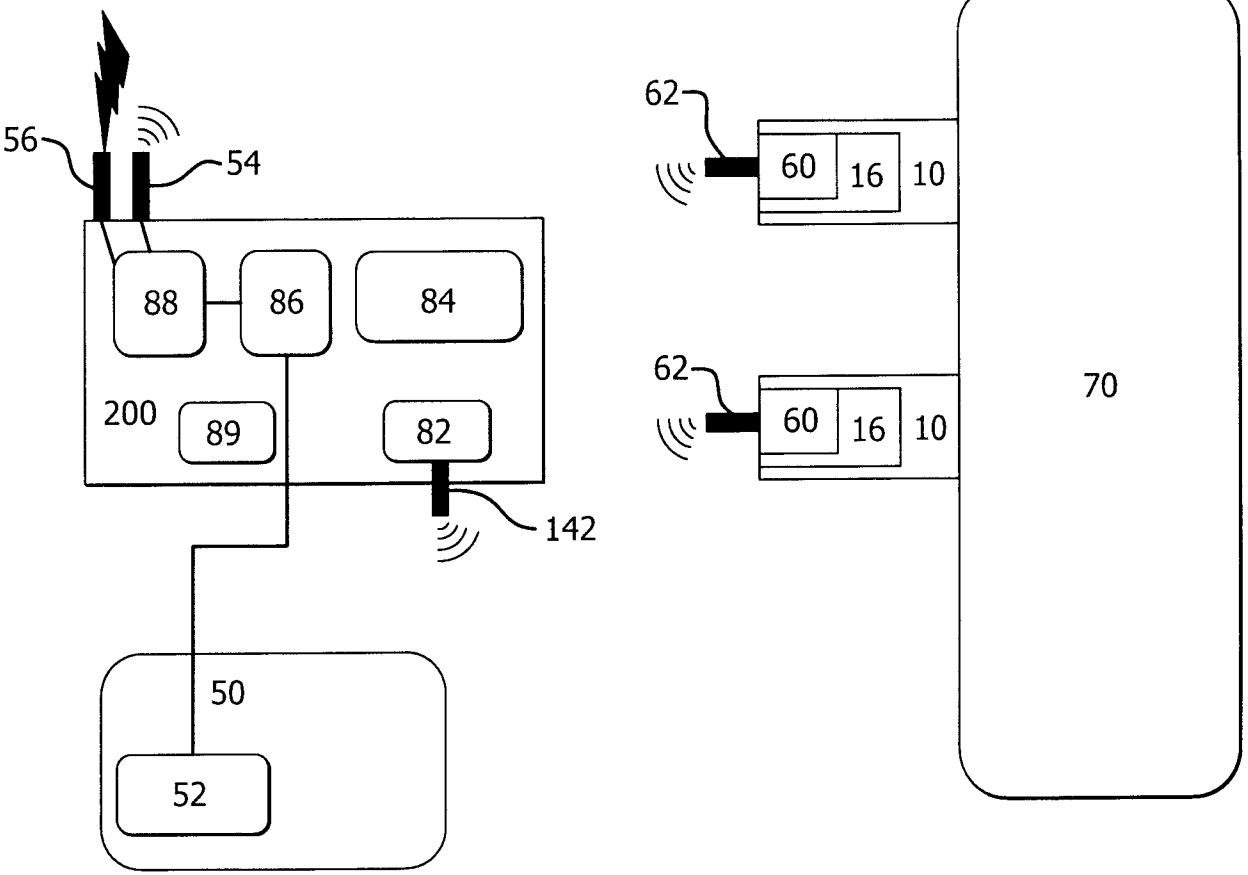
FIG. 1 is a schematic showing components of a communication system for collecting, transmitting, and analyzing data collected from various sensors on a burner.

FIG. 1 is a schematic of an exemplary system for handling the burner data, it being understood that various alternative combinations of hardware, firmware, and software could be configured and assembled to accomplish the same functions. One or more burners 10 may be mounted in the furnace 70, each burner 10 having an instrument enclosure 16 as described above. In the schematic of FIG. 1, multiple burners 10 are mounted in the furnace 70. Each instrument enclosure 16 contains a data collector 60 for collecting and aggregating the data generated by each of the sensors on the burner 10, and a wireless transmitter 62 for transmitting the data from the data collector 60, as well as other components such as a power supply. The data collector 60 is programmable via one or more of hardware, firmware, and software, independently or in combination, to perform application-specific functions.

In an exemplary embodiment, the data collector 60 at each burner 10 aggregates data for that burner 10 using a highly configurable Wireless Intelligent sensor Node (WIN). The data collector 60 powers the various sensors associated with the burner 10, and is programmed to convert a battery voltage of between 3.2V and 6V, for example to the correct voltage required by each sensor (e.g., 12V). The battery voltage can be supplied by locally mounted batteries that are replaceable or that are charged by local power generation. In one embodiment, the sensors transmit analog output signals that are read via an analog to digital converter with a programmable gain amplifier to take into account the output range of each sensor. In another embodiment, the sensors transmit digital output signals that are scaled, or that may be scaled, based on the output range of each sensor.

The data collector 60 is also capable of reading digital sensors or indicators such as a serial number. An internal temperature sensor allows monitoring of the ambient temperature and thus cold junction compensation of thermocouples. An internal accelerometer allows the attitude of the node (and therefore what it is attached to) to be measured. Advanced power management is used to maximize battery life. In particular, the data collector 60 is programmed to power the sensors when measurements are to be taken, either based on a combination of sensed conditions or on a regular schedule.

The sensor measurements are consolidated, taking into account the gain of the amplifier taken, cold junction compensation, and any other relevant factors, and transmitted to a data receiving/processing center 200, preferably via a wireless link. In an exemplary embodiment, the wireless link uses the 2.4 GHz ISM band and the 802.15.4 standard as its physical layer and Medium Access Control (MAC). However, any other wireless link now known or later developed that is suitable for the operating environment could be used. The protocol uses a star network topology. Alternative frequencies and protocols are possible, including without limitation mesh network topologies. The 2.4 GHz band was chosen since it is a worldwide ISM band while most other ISM bands are country specific. The wireless link to the node is bidirectional to allow configuration of the node over the air. The data may be encrypted prior to transmission for security purposes. The data may be transmitted directly from the data collector 60 to the data center 200, or indirectly via one or more Wi-Fi repeaters depending on the distance and signal path between the burner 10 and the data center 200.

The data center 200 is configured to receive data from the individual burners 10, and may also be configured to provide that data to a control computer 52 (which may be located in a control room 50 or elsewhere), and to transmit data, information, and alerts wirelessly for local-remote and distant-remote access. Alternatively, data could be transmitted from the data center 200 to a cloud-based server which can then serve data, provide alerts, and perform any other computational function via the Internet or other network. The data center 200 may be a single piece of hardware configured and programmed to perform all of the necessary functions described below. Alternatively, as in the exemplary embodiment illustrated in FIG. 2, the data center 200 may include several components that cooperate with each other to perform the desired functions. In the illustrated embodiment, the data center 200 includes a data receiver or gateway 82 configured to receive the data via antenna 142 from the individual data transmitters 60 and communicates the data to a server 84. In a further alternate configuration, the server 84 may be located remotely in the cloud.

The server 84 preferably includes a CPU, RAM, ROM, and access for input/output devices and removal storage devices. The server 84 may be a specially programmed general purpose computer, a customized computer, a programmable logic control, or other combination of hardware, firmware, and software that may be programmed to accomplish the desired functions. The server 84 may be programmed or configured by any combination of hardware, firmware, and software, and may store data locally, on a remote server, or in the cloud.

Further, any computing functions performed by the server 84 may be performed by a server located either locally or in the cloud. As used herein, the "cloud" is understood to encompass a distributed computing system designed to operate over a network, were a computer application (including without limitation data analysis, graphing, alarming, trending, comparison of data sets) may be performed on a remote computer or server that is connected via a communication network to the server 84 and the other of the components of the data center 200. The network may include one or more of the Internet, an intranet, a local area network (LAN), and a wide area network (WAN).

The server 84 aggregates the data from the potentially multiple burners and is configured to serve up the data in the form of a display format such as an Internet web page format, or a mobile device app format (e.g., iOS or Android), or another existing or future developed interface protocol, to local and/or remote users with appropriate security measures that may be used to limit access to some or all of the data for particular users or user groups.

Alternatively, as noted above, the functions of the server 84 can be performed by a cloud-based server, either alone or in combination with a local server, wherein the cloud-based server performs some or all of the computational functions, including but not limited to serving data in the web page format, mobile device app format, or other format that would enable a device to display data, alerts, historical trending, and other information resulting directly or indirectly from processing the data. As discussed further below, a cloud-based server would provide advantages over local servers, including gains in efficiency and cost-effectiveness from having a more powerful cloud-based server perform computationally intense analysis and store large amounts of historical and comparative data and analysis that would be accessible anywhere that has network access.

The server 84 may be configured to log data, as well as to pass the data through to an Ethernet switch or router 86, or a serial device or other device for transmitting data, which provides local data transmission and network connectivity. A modem 88 connected to the Ethernet switch 86 transmits data remotely. In the exemplary embodiment, the modem 88 is configured to transmit data to a cellular network via a cellular antenna 56 and to a Wi-Fi network via a Wi-Fi antenna 54. However, it is understood that two separate units, a cellular modem and a Wi-Fi router, may be separately connected to the Ethernet switch 86 in place of the modem 88. Alternatively, Wi-Fi router may be incorporated into the Ethernet switch 86. The display format is broadcast using one or more of wired Ethernet, Wi-Fi, and cellular transmission via the modem 88 in combination with the router 86, or alternatively via a combination modem/router. Alternatively or in addition, the display format may be broadcast via the Internet or other network from a cloud-based server. An uninterrupted power supply (UPS) 89 may be provided to maintain functioning of the data center 200 in the event of a brief loss of external power. As discussed above, external power may be supplied to the data center 200 by a local power generation system as shown in FIG. 6.

The computer 52 may be connected to the data center 200 either via Ethernet wired connection or wireless connection. The computer 52 preferably includes a CPU, RAM, ROM, a display, input/output devices, and access ports for removable storage devices. The computer 52 may be a specially programmed general purpose computer, a customized computer, a programmable logic control, or other combination of hardware, firmware, and software that may be programmed to accomplish the desired functions. The computer 52 may be used by an operator for local data viewing and/or configuration of the server 84 and other components of the data center 200.

Alternatively, instead of having a computer and program locally, cloud computing could be used to serve the same purpose. Cloud computing could facilitate maintenance of the software and associated hardware at remote sites, such as at customer facilities. Cloud computing could also enable computationally intensive live statistical analysis of data to be performed and the analysis results incorporated into a web application hosted on the cloud computer(s). Such computationally intense analysis may be cost prohibitive to be performed on numerous distributed computer systems at individual customer sites but could be very cost effective using cloud computing.

While the above example lists specific equipment and configurations, the system can be constructed using various interchangeable or comparable methods and equipment to accomplish the same data flow shown in FIG. 2 (described below).

Once collected, the burner data can be monitored in any of several ways. As described above, the computer 52, in addition to or separately from the server 84, may be configured and programmed to serve up a data in a display format, such as an Internet web page format or mobile device app format, for users to view the current data, data trends, download historical data (all of which can be stored on the local computer, in the cloud, or in some other remote location), and to configure alarms, choose language (e.g., English or Chinese or any other desired language), gather internal system status information (e.g., to indicate loss of communication with a component or an internal component failure), and perform other basic maintenance steps. All of these requests are handled through the data center 200.

Figure 2:
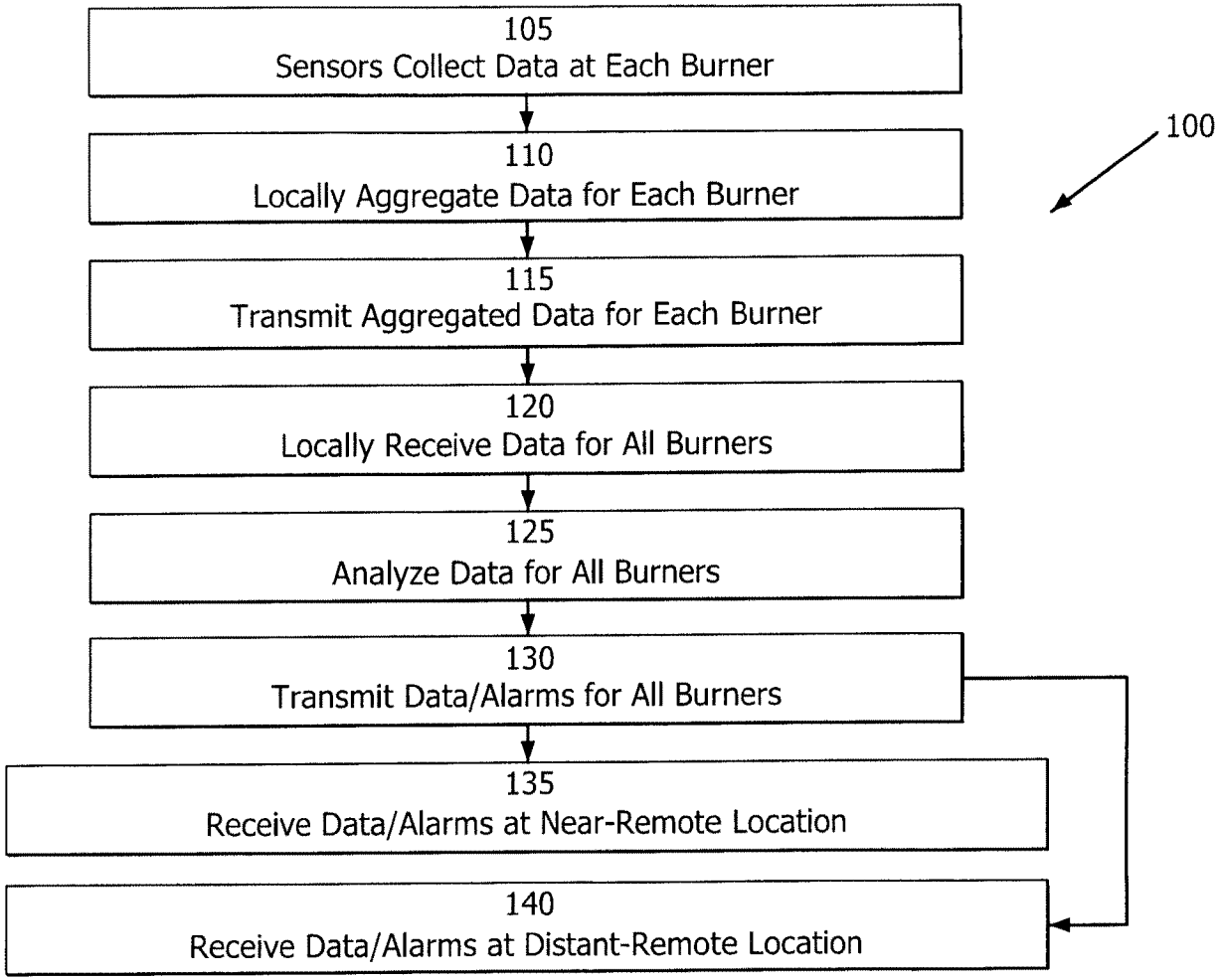
FIG. 2 is a data flow chart indicating schematically the flow, analysis, and use of data from various sensors on a burner.

FIG. 2 is an exemplary process flow chart for a process 100 of handling data sensed by the burners and making that data, as well as any analytical results and alerts, accessible remotely at local-remote or distant-remote locations. As shown in step 105, each instrumented burner 10 collects data from its various sensors. In step 110, the data for each burner 10 is aggregated by the data collector 60 located on or near the burner, and in step 115, that data is transmitted from the data collector 60 via a wireless transmitter 62 to the data center 200. Alternatively, the transmission may be done by a wired transmission means, but is preferably done wirelessly via any technology available for that purpose, whether currently existing or future-developed.

In step 120, the data is received from the various burners 10 by the data receiver 82 in the data center 200. In step 125, the server 84 in the data center 200 aggregates the data and performs any desired analysis. For example, the server 84 may compare present data values to alarm or alert threshold values to determine whether alerts are desirable or required, and may also analyze combinations of sensor data against a theoretical and experimental database to determine whether maintenance is required or another condition exists that requires attention. Alternatively, as discussed above, such analysis and alarm determination may be performed by a cloud computing system.

In step 130, the aggregated data along with the results of any analysis are transmitted to an alerting system. In step 135, a device at a near-remote location, such as a handheld device, tablet, portable computer, or the like receives wireless signals from the Wi-Fi antenna 54. The near-remote device can display current data and trends, historical data and trends, and analysis results, and can provide appropriate alerts to an operator or the like if an abnormal or undesired operational condition has been detected. Alternatively or sequentially or approximately simultaneously, a device at a distant-remote location, such as a handheld device, tablet, computer, or the like receives cellular signals, either directly or through any other wired or wireless system configured to access the Internet. Similarly, the distant-remote device can display current data and trends, historical data and trends, and analysis results, and can provide an appropriate alert to an operator or the like if an abnormal or undesired operational condition has been detected.

Various methods may be used to detect abnormal or suboptimal performance of the one or more burners 10. Many standard control methods exist, such as control charts, control limits, Western Electric rules, methods based on principal components or partial least squares of "normal" data, or any other standard fault detection methods. In addition, the data center 200 can provide comparisons between burners and set alarms based on those comparisons. The data center 200 can also serve up the data in modified formats using predetermined conversions to display calculated values such as flowrates, firing rates, viscosity estimates, burner stoichiometries, and other types of calculated parameters. Limits used in these calculations and comparisons can be performed via a web page or a customized application. The web page format is preferred since it is cross platform and is thus more flexible, and also enables a user to view data and analysis results on a multitude of devices through a simple interface design. Common data storage and data transfer protocols in use (e.g., SQL database and associated queries) can be used to interface with device specific applications (such as iOS or Android apps) for a richer user interface.

In addition to alerts related to the burner, the system can also convey information relating to the communication status of the system, estimates about lifetime remaining for the battery, wireless signal strength, communication errors, sensor malfunctions, and other type of information can be transmitted from the burner and alerts sent to users. In particular, the system may be configured to detect and provide notification of, among other events, sensor failure (e.g., from loss of signal), battery depletion (e.g., loss of communication with a lance), disconnection or failure of individual cables (e.g., loss of burner ID in the data stream), loss of internet connectivity. Any or all of such events can be displayed on a status page on the display interface.

The system can also alert users to abnormal and/or suboptimal operation. The alerting can be done via any standard method including through the use of lights or audible alarms in the control room, at the burner, at the flow control skid, or at any other convenient location. In addition the webpage can be modified to indicate alarms or the system could send out emails and/or text messages to identified users.

The present invention is not to be limited in scope by the specific aspects or embodiments disclosed in the examples which are intended as illustrations of a few aspects of the invention and any embodiments that are functionally equivalent are within the scope of this invention. Various modifications of the invention in addition to those shown and described herein will become apparent to those skilled in the art and are intended to fall within the scope of the appended claims.

The invention claimed is:

1. A remote burner monitoring system comprising:

one or more burners mounted in a furnace, each burner including:

integrated sensors; and an instrument enclosure positioned toward a rear of the burner distal from the furnace, the instrument enclosure containing:

a data collector corresponding to the burner for receiving and aggregating data from the integrated sensors of the burner, and a local transmitter for transmitting the data aggregated by the data collector;

a data center configured and programmed to receive the data from each of the local transmitters; and a server configured and programmed to store at least a portion of the data, to convert the data into a display format, and to provide connectivity to enable receipt and transmission of data and the display format via a network including at least one of a wired network, a cellular network, and a Wi-Fi network;

wherein the data collector of each of the burners is programmed to provide power to individual sensors only when data is to be collected, based on one or both of a combination of sensed data and a periodic schedule, and taking into account the specific requirements of each of the individual sensors.

2. The system of claim 1, further comprising:

a computer configured and programmed to transmit and receive data to and from the network.

3. The system of claim 1, wherein the data center includes one or more of a data receiver for receiving the data, a server for storing at least a portion of the data, and a router for providing connectivity to enable network receipt and transmission of data.

4. The system of claim 1, wherein the data collector of each of the burners is programmed to provide a correct voltage to each of the integrated sensors of the burner.

5. The system of claim 1, wherein the local transmitter corresponding to each of the burners transmits data wirelessly, either directly to the receiver server or indirectly via one or more Wi-Fi repeaters, as required by the distance and signal path between the burner and the receiver server.

6. The system of claim 1, wherein the display format is selected from the group consisting of: an Internet web page format and a mobile device app format.

7. The system of claim 1, wherein the data collector corresponding to each burner is powered by local energy harvesting.

8. The system of claim 1, wherein at least one of the burners uses an oxidant selected from the group consisting of: air, oxygen-enriched air, industrial grade oxygen, and combinations thereof.

9. The system of claim 8, wherein at least one of the burners is configured to combust a fuel selected from the group consisting of: gaseous fuel, liquid fuel, solid fuel, and combinations thereof.

10. The system of claim 8, wherein at least one of the burners is configured to perform staged combustion.

11. The system of claim 1, wherein the server is integrated with the data center.

12. The system of claim 1, wherein the server is located in the cloud.

13. A method of monitoring operation of one or more burners, the method comprising:

sensing operational data at each of the burners;

locally collecting the data at each of the burners via a corresponding data collector mounted in an instrument enclosure on each of the burners;

transmitting the collected data from each of the burners to a data center via a corresponding transmitter mounted in the instrument enclosure corresponding to the data collector for each said burner;

converting the data into a display format;

transmitting the display format via a network including at least one of a wired network, a cellular network, and a Wi-Fi network; and providing power to individual sensors sensing the operational data only when the data is to be collected, based on one or both of a combination of sensed data and a periodic schedule, and taking into account the specific requirements of each of the individual sensors.

14. The method of claim 13, wherein converting the data into a display format comprising serving up the data in one or more of an Internet web page format and a mobile device app format.

15. The method of claim 13, further comprising:

transmitting the collected data from the data center via the network to the cloud;

storing the collected data in a remote data repository; and enabling access via the network to the collected data stored in the remote data repository.

16. The method of claim 13, further comprising:

analyzing the collected data including performing statistical analysis of the collected data corresponding to one of the burners, performing comparative analysis of the collected data between two or more of the burners, comparing the collected data for one or more of the burners to preset alarm setpoints and generating alarms, and combinations thereof.

17. The method of claim 13, further comprising:

controlling operation of the one or more burners based on the collected data and analysis of the collected data;

wherein controlling operation includes one or more of maintaining burner operating parameters within prescribed limits, tuning local flame characteristics, and rapidly responding to adverse burner conditions.

18. The method of claim 17, wherein the adverse burner conditions include one or more of an elevated temperature of a burner component, an elevated temperature of a furnace component, and flame instability.

* * * * *